US005311647A

United States Patent [19]

Levy

[11] Patent Number: 5,311,647

[45] Date of Patent: * May 17, 1994

[54] JEWELRY CLOSURE HAVING BOTH MAGNETIC AND MECHANICAL CLASPS

[76] Inventor: Davida Levy, 1340 Biscaya Dr., Surfside, Fla. 33154

[ * ] Notice: The portion of the term of this patent subsequent to Mar. 3, 2009 has been disclaimed.

[21] Appl. No.: 78,886

[22] Filed: Jun. 21, 1993

Related U.S. Application Data

[63] Continuation-in-part of Ser. No. 536,777, Jun. 12, 1990, Pat. No. 5,008,984, and a continuation-in-part of Ser. No. 688,102, Apr. 19, 1991, Pat. No. 5,092,019, and a continuation-in-part of Ser. No. 844,863, Mar. 2, 1992.

[51] Int. Cl.[5] ..... A44B 21/00

[52] U.S. Cl. ..... 24/303; 24/616

[58] Field of Search ..... 24/303, 616, 615, 618, 24/662, 106, 3 J, 3 K, 671, 673, 674; 292/251.5; 70/457; 459; 63/15.1, 15.3, 15.7

[56] References Cited

U.S. PATENT DOCUMENTS

| | | | |
|---|---|---|---|
| 1,774,347 | 8/1930 | Bainton | 24/674 |
| 2,771,768 | 11/1956 | Tudor | 70/457 |
| 3,129,477 | 4/1964 | Mizuno | 24/303 |
| 3,263,444 | 8/1966 | DiCroce | 24/303 |
| 4,246,679 | 1/1981 | Monett | 24/671 |
| 4,543,692 | 10/1985 | Ode et al. | 24/616 |
| 5,092,019 | 3/1992 | Levy | 24/303 |

FOREIGN PATENT DOCUMENTS

| | | | |
|---|---|---|---|
| 0854666 | 11/1960 | United Kingdom | 24/662 |

*Primary Examiner*—Victor N. Sakran
*Attorney, Agent, or Firm*—Keck, Mahin & Cate

[57] ABSTRACT

A jewelry closure includes a magnetic closure and a mechanical closure which is a safety feature, preventing the magnetic closure from being opened inadvertently. The mechanical closure includes a wire member partially embedded in a groove in a first jewelry closure member and a groove for receiving the wire member in a second jewelry closure member. The magnetic and mechanical closures are closed substantially simultaneously.

6 Claims, 1 Drawing Sheet

JEWELRY CLOSURE HAVING BOTH MAGNETIC AND MECHANICAL CLASPS

RELATED APPLICATIONS

This application is a continuation-in-part of Ser. No. 536,777, filed Jun. 12, 1990, now U.S. Pat. No. 5,008,984, issued Apr. 23, 1991; Ser. No. 688,102, filed Apr. 19, 1991, now U.S. Pat. No. 5,092,019, issued Mar. 3, 1992; and Ser. No. 07/844,863, filed Mar. 2, 1992, presently pending, the disclosures of which are incorporated herein by reference.

BACKGROUND OF THE INVENTION

Known magnetic closures include that shown in Mizuno, U.S. Pat. No. 3,129,477. Such a magnetic closure, without a safety feature may have a perceived lack of strength due to the absence of a mechanical closure.

In my previous patents, various mechanical clasps are shown in combination with a magnetic clasp. In particular, a further embodiment of the clasp described in U.S. Pat. No. 5,092,019, is described herein.

SUMMARY OF THE INVENTION

The invention provides a jewelry closure having both a magnetic closure and a mechanical safety closure. This jewelry closure is suitable for use for closing necklaces, bracelets or other articles of jewelry. The mechanical closure is a safety feature which prevents the magnetic closure from being opened inadvertently.

One or preferably both members of the closure include a magnet for allowing the closure members to engage together magnetically for joining ends of the jewelry or other item to be closed. A first magnet is supported in a casing which receives the second magnet supported in a casing enabling both closure members to be magnetically engaged together. The mechanical closure is engaged substantially simultaneously with the engagement of the magnetic closure.

Each of the closure members has a groove around its outer circumference and a wire member is partially embedded in the groove in one of the closure members. When the magnetic and mechanical closures are engaged, the wire member engages in the groove in the other of the closure members. The wire member preferably does not extend completely around the circumference of the closure member, but has a gap between its ends when disposed in the groove, as discussed above. The wire member is thus shorter than the length of the groove in the perimeter of the closure member. This allows sufficient resilience and flexibility for proper closing. The wire member may be replaced by a bead, but a wire member is preferred for ease of manufacture.

An object of the invention is to provide a jewelry closure having a magnetic closure and an additional mechanical safety closure.

DETAILED DESCRIPTION OF THE PREFERRED EMBODIMENTS

A jewelry closure of the invention includes first and second closure members for engaging together magnetically and mechanically. At least one of the first and second closure members includes a magnet. In addition to the magnetic closure, a mechanical closure includes a member attached to the first closure member for engaging a complementary portion of the second closure member when the second closure member is held by magnetic attraction to the first closure member. The magnetic and mechanical closures are secured substantially simultaneously.

According to the invention, the mechanical closure has a groove on a first magnetic closure member and a substantially complementarily shaped wire or a wire-like member partially embedded in the groove on the second magnetic closure member which engages the wire or wire-like member when the magnetic and mechanical closures are secured. The wire may, alternatively, be partially embedded in the first magnetic closure member for engaging with a groove in the second magnetic closure member.

A wire, partially embedded in a groove is preferred for the first member of the closure. A wire-like portion, such as a bead may be used in place of the wire. The complementarily shaped portion is an annular groove in which the wire or bead is engaged when the magnetic and mechanical closures are secured.

Figure 1:
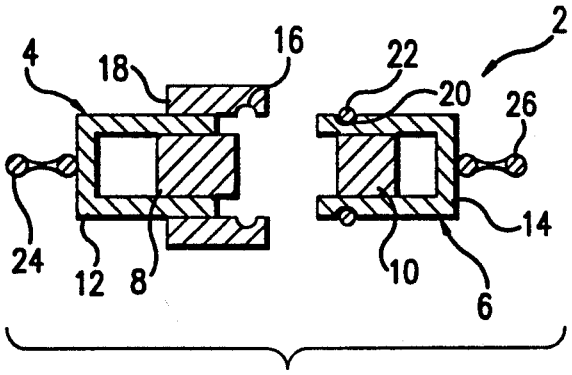
FIG. 1 is a schematic cross-sectional view of a jewelry closure of the invention in open position.

With reference to FIGS. 1 to 6, in which like numerals represent like elements, FIG. 1 illustrates jewelry closure 2 having a first magnetic closure member 4 and a second magnetic closure member 6. Magnet 8 is secured, adhesively or as otherwise known in the art, to first magnetic closure member 4 and magnet 10 is similarly secured to second magnetic closure member 6. Casing 12 of first magnetic closure member 4 holds magnet 8 and casing 14 of second magnetic closure member 6 holds magnet 10. Groove 16 extends annularly around an inside surface of band 18 which is attached to first magnetic closure member 4. Band 18 extends around the outer perimeter of first magnetic closure member 4 and extends forward therefrom for receiving second magnetic closure member 6. Groove 20 extends annularly around second magnetic closure member 6. Wire member 22 is disposed in groove 20. Rings 24, 26 are attached to magnetic closure members 4, 6, respectively, for attaching jewelry, as known in the art.

The forward surfaces of magnets 8, 10 may be substantially coplanar with ends of casings 12, 14, or one magnet may protrude and the other magnet may be recessed. FIG. 1 shows magnet 8 extending forward of casing 12 and magnet 10 recessed in casing 14. Other arrangements will be apparent to one skilled in the art.

Figure 2:
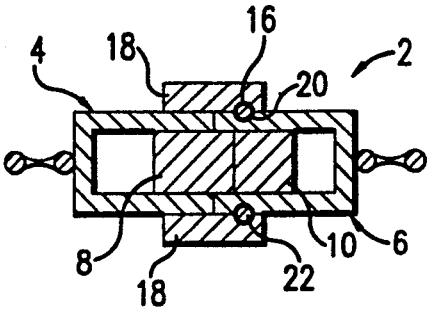
FIG. 2 is a schematic cross-sectional view of a jewelry closure of FIG. 1 in closed position.

FIG. 2 illustrates the jewelry closure of FIG. 1 in closed position. Wire member 22 disposed in groove 20 on second closure member 6 is engaged in groove 16 on band 18 of first magnetic closure member 4.

Figure 3:
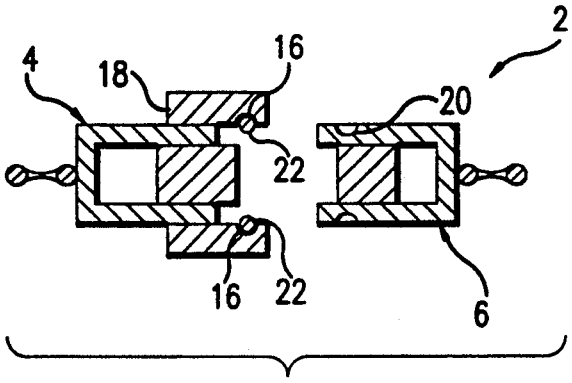
FIG. 3 is a schematic cross-sectional view of another jewelry closure, in open position.
Figure 4:
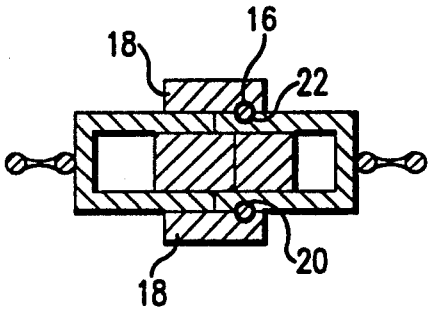
FIG. 4 is a schematic cross-sectional view of a jewelry closure of FIG. 3, in closed position.

FIGS. 3 and 4 are similar to FIGS. 1 and 2, respectively. FIG. 3 illustrates wire 22 disposed in groove 16 on band 18 of first magnetic closure member 4. FIG. 4 illustrates the closed jewelry closure having wire 22 engaged in groove 20 in second magnetic closure member 6.

Figure 5:
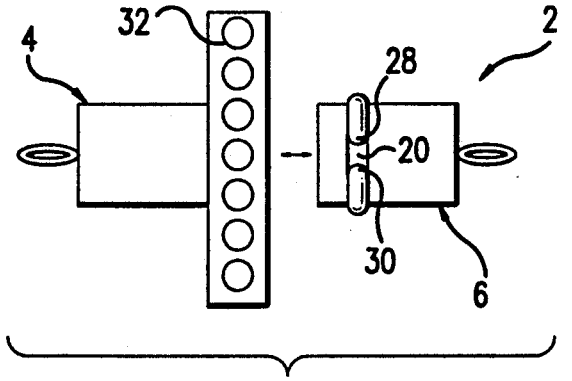
FIG. 5 is a side elevational view of an open jewelry closure having an ornamented band.

In a preferred embodiment, shown in FIG. 5, ends 28, 30 of wire 22 disposed in groove 20 of one of the magnetic closure members do not meet, but a gap is left between the ends to allow flexibility and resilience in closing the mechanical closure and promoting proper functioning of the jewelry closure.

Figure 6:
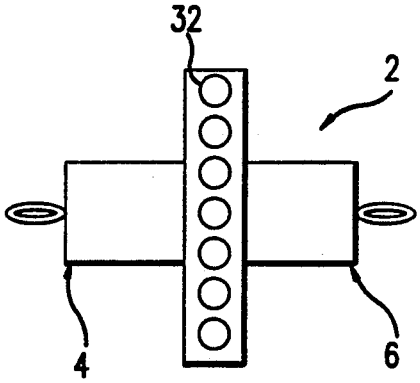
FIG. 6 is a side elevational view of a closed jewelry closure of FIG. 5.

FIGS. 5 and 6 illustrate a jewelry closure member having an ornamented band 32, such as a band ornamented with colored stones.

A jewelry closure of the invention may be made of metal and/or plastic. The surfaces may be metal plated or otherwise coated and/or colored to provide a desired appearance. The wire partially embedded in one of the grooves may be made of metal or plastic. Appropriate materials will be apparent to those skilled in the art.

The closures may have any appropriate shape, for example they may have a circular, oval, square, rectangular, hexagonal or other cross-sectional shape, as known in the art. Preferably the shape is such that magnets having a circular face may be used, but any shape of magnet may be used according to the purpose of the closure.

Other uses for the magnetic/mechanical closure described herein will be apparent to those skilled in the art. Both the magnetic and mechanical closures must be engaged substantially simultaneously to secure the jewelry closure. Likewise both the magnetic and mechanical closures must be released substantially simultaneously to release the jewelry closure.

While the invention has been described above with respect to certain embodiments thereof, variations and modifications may be made without departing from the spirit and scope of the invention.

What is claimed is:

1. A jewelry closure comprising:

a magnetic closure comprising first and second closure members for engaging together magnetically, wherein at least one of said first and second closure members comprises a magnet;

a casing for supporting said first closure member and extending outwardly for engaging said second closure member; and a mechanical closure on said casing for engaging said second closure member when said second closure member is held by magnetic attraction to said first closure member, wherein said mechanical closure member comprises an annular groove on each member and a wire member partially embedded in a first of said grooves, wherein said wire member engages in a second of said grooves when said first and second members are engaged together, and said magnetic and mechanical closures must both be released in order to open the jewelry closure.

2. A jewelry closure according to claim 1 wherein said wire member comprises a bead partially embedded in said groove.

3. A jewelry closure according to claim 1 wherein said wire member comprises a material selected from the group consisting of metal and plastic.

4. A jewelry closure according to claim 1 wherein said wire member is shorter than the length of the annular groove.

5. A jewelry closure according to claim 1 wherein one of said closure members further comprises a band extending around the circumference thereof.

6. A jewelry closure according to claim 5 wherein said band comprises an ornamental band.

* * * * *